United States Patent [19]

Seidel

[11] 4,073,073

[45] Feb. 14, 1978

[54] SKIING BOOT

[75] Inventor: Sigurd Seidel, Graz, Austria

[73] Assignee: Skischuhfabrik Dynafit Gesellschaft m.b.H., Graz, Austria

[21] Appl. No.: 742,061

[22] Filed: Nov. 15, 1976

[51] Int. Cl.[2] ..... A43B 11/00; A43B 21/00; A43B 5/04

[52] U.S. Cl. ..... 36/50; 36/105; 36/121

[58] Field of Search ..... 36/105, 117, 118, 120, 36/119, 121, 50; 24/251

[56] References Cited

U.S. PATENT DOCUMENTS

| | | | |
|---|---|---|---|
| 3,408,752 | 11/1968 | Lollmann | 36/105 |
| 3,798,799 | 3/1974 | Hanson et al. | 36/119 |
| 3,848,347 | 11/1974 | Hanson et al. | 36/50 |

FOREIGN PATENT DOCUMENTS

| | | | |
|---|---|---|---|
| 1,475,936 | 2/1966 | France | 36/50 |
| 2,105,089 | 2/1971 | Germany | 36/50 |

*Primary Examiner*—Patrick D. Lawson
*Attorney, Agent, or Firm*—Fleit & Jacobson

[57] ABSTRACT

A skiing boot comprises an upper which has a rear portion that extends upwardly and forwardly and is formed at least at its upper end with a substantially central slot, which is adapted to be closed by means comprising ribs, such as rails, beads or the like extending along both sides of said slot, and a slider, which is adjustably mounted on said ribs and adapted to be fixed in any desired position, if desired.

4 Claims, 7 Drawing Figures

SKIING BOOT

SUMMARY OF THE INVENTION

A skiing boot having an upper which is formed in its rear portion with a central slot, which is open at the upper end of said rear portion and is defined by ribs, and a slider, which serves to close the slot and is mounted on and slidable along the ribs.

This invention relates to a skiing boot which comprises an upper having a rear portion which extends upwardly and forwardly and is formed at least at its upper end with a substantially central slot, which is adapted to be closed.

Skiing boots should be designed to transmit the movement of the body of the skier to the skis exactly and without delay. As a skier must push his knees forward for a satisfactory technique, skiing boots are desired in which the rear portion of the upper extends upwardly and forwardly to support the lower legs of a skier when he has pushed forward his knees. On the other hand, the wearer of such skiing boots having uppers which extend upwardly and forwardly at the rear can walk only with difficulty. To avoid these disadvantages, a skiing boot has been proposed in which the upper has an upwardly and forwardly extending rear portion, which is formed with a central slot, which is adapted to be closed by means of buckles, a lace, or a slide fastener. Fastening laces can be manipulated only with difficulty, particularly when snow adheres to them or when the wearer wears gloves. Fastening buckles attached to the upper at the rear may be caught by obstacles and adversely affect the appearance of the skiing boot. Slide fasteners have only a low strength and are liable to be deranged.

It is an object of the invention to avoid the disadvantages of the known skiing boots and to provide the upper of a skiing boot at its rear with a fastener which can easily and effectively be operated even under most adverse conditions.

In a skiing boot in which the upper is slotted at the rear, this object is accomplished according to the invention in that a slider is adjustably mounted on ribs extending along the sides of the slot.

Further details of the invention will be explained more fully with reference to the drawings, in which two embodiments of the skiing boot according to the invention are shown by way of example.

Numeral 1 designates an upper of a skiing boot. The general design and details of said skiing boot will not be described more fully because they are not significant for the present invention. For instance, the skiing boot may consist of a simple skiing boot or, as indicated in FIG. 1, may comprise an outer boot and an inner one.

Figure 1:
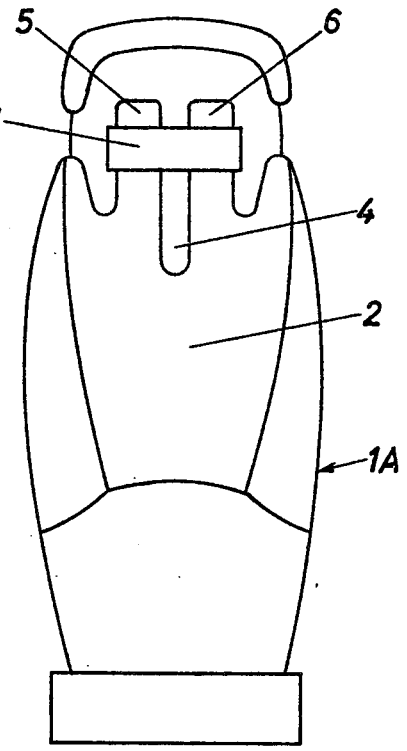
FIG. 1 is a rear elevation showing a skiing boot having an upper which is closed at the rear by a clip.
Figure 2:
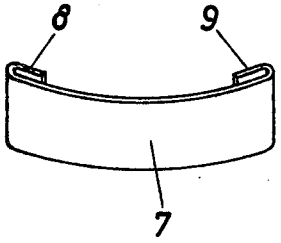
FIG. 2 is a perspective view showing the clip which closes the upper of the skiing boot of FIG. 1 at its rear.
Figure 7:
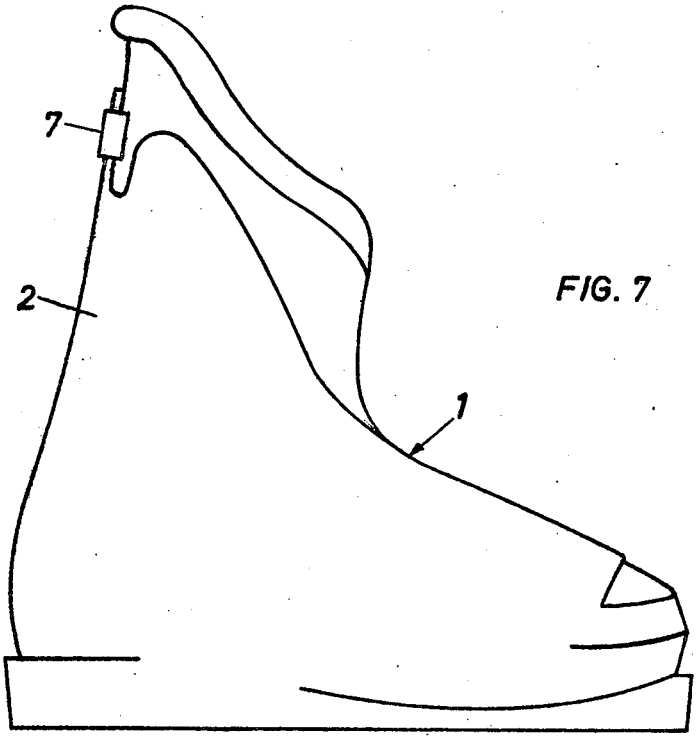
FIG. 7 is a side elevation showing a skiing boot which may be provided with a fastener as shown in FIGS. 3 to 6.

In the skiing boot shown in FIG. 1, the upper of the outer boot 1A has a rear portion 2, which is formed with a central slot 4 that is defined by two lip-forming ribs 5, 6 provided on the rear portion 2 of the upper. A clip 7 conforms to the horizontal curvature of the rear portion of the upper and has reversely bent end portions 8, 9, which are engageable with said ribs 5, 6 so that the latter cannot be spread apart. p As is apparent from FIG. 7, the rear portion of the upper of the skiing boot extends upwardly and forwardly so that the foot of the skier is forced to assume a position in which the knees are pushed forward for a perfect skiing technique.

When the wearer desires to walk or when he is travelling, the clip 7 can be removed or shifted downwardly so that the slot at the rear of the upper can be spread open and the leg can assume an upright position.

Figure 3:
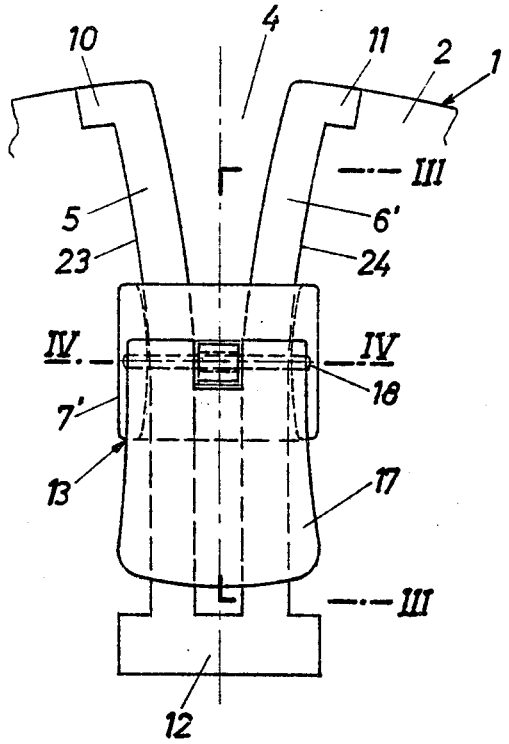
FIG. 3 is a top plan view showing the rear portion of the upper of a skiing boot together with another embodiment of the means provided according to the invention for closing the slot at the rear of the upper.

In the skiing boot shown in FIG. 3, the slot 4 is defined at its longitudinal sides by ribs 5', 6' consisting of rails or beads. These ribs protrude from the outside surface of the boot and are provided at their ends with stops 10, 11, 12, which are engageable by a slider 13, which is slidable along the ribs 5', 6' and adapted to be fixed in any desired position. The slider 13 comprises a stem 15, which extends through the slot 4 and carries a head 14 that bears on the inside of the rear portion 2 of the upper, a clip 7', which embraces the ribs 5', 6' and has a hole 16, in which the stem 15 is slidably fitted, and an eccentric lever 17, which is pivoted on a pin 18. The latter is fitted in a transverse bore 19 at the outer end of the stem 15. The head 14 carried by the stem 15 as well as the clip 7' conform to the curvature of the rear portion 2 of the upper. The head 14 is received in recesses 20 formed on the inside of the upper on both sides of the slot so that the head 14 cannot apply pressure to the heel of the skier.

The leg portions 21, 22 of the clip 7' engage the outer edge faces 23, 24 of the ribs 5', 6' and have cambered inside bearing surfaces 25, 26 so that the slider 13 can be pulled up in such a manner that the diverging rib portions defining the still open portion of the slot are drawn into the opening of the clip without a risk of a canting of the clip 7'.

Figure 4:
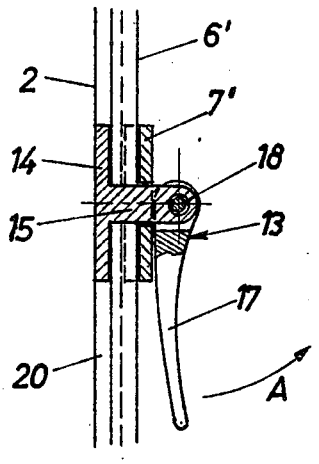
FIG. 4 is a sectional view taken on line III—III in FIG. 3
Figure 5:
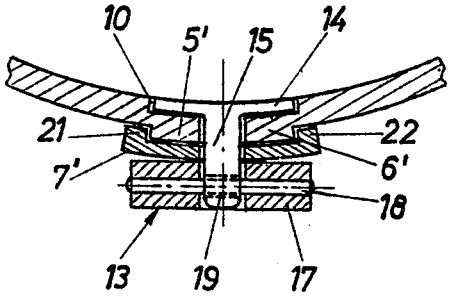
FIG. 5 is a sectional view taken on line IV—IV in FIG. 3.
Figure 6:
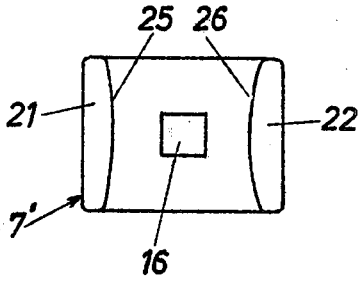
FIG. 6 is a bottom view showing the clip.

The mode of operation of the fastener which has been described are readily apparent from the foregoing description in conjunction with the drawing. In the position shown in FIG. 4, the eccentric lever 17 draws the stem 15 against the clip 7' to fix the slider 13 in its adjusted position. To release the slider 13, the eccentric lever 17 is raised in the direction of the arrow A in FIG. 4 so that the slider 13 can then be shifted upwardly or downwardly, as desired. The slider is moved to its uppermost position when the wearer of the boot desires to ski and to its lowermost position when the wearer desires to walk without wearing skis. An intermediate position can be selected for a short rest.

It will be understood that various changes in design may be adopted within the scope of the invention. For instance, the cambered bearing surfaces 25, 26 need not have a perfect camber but may have any outwardly diverging configuration which ensures that the slider 13 will be jammed as it is shifted in one the other of the directions in which it is adjustable.

What is claimed is:

1. A skiing boot comprising an upper having a rear portion that extends upwardly and forwardly and is formed at least at its upper end with a substantially central slot, which is adapted to be closed by means comprising ribs extending along the edges of said slot, and a slider adjustably mounted on said ribs, said slider having a stem extending through said slot, a bearing member carried by said stem and engaging the inside of the upper on both sides of said slot, a clip fitted on said stem and embracing said ribs, and eccentric means adapted to assume an operative position in which said eccentric means forces the bearing member and the clip towards each other so as to grip said ribs between said bearing member and the clip.

2. A skiing boot as set forth in claim 1, in which said bearing member is received in recesses formed in said upper on both sides of said slot.

3. A skiing boot as set forth in claim 1, in which said clip has projections formed with cambered guiding surfaces for engaging said ribs at side faces thereof which are remote from said slot.

4. A skiing boot as set forth in claim 1, in which said eccentric means includes a lever and a pin extending through the outer end portion of said stem for pivotally mounting the lever.

* * * * *